US006575256B1

(12) United States Patent
Doster

(10) Patent No.: US 6,575,256 B1
(45) Date of Patent: Jun. 10, 2003

(54) DRILL BIT WITH LATERAL MOVEMENT MITIGATION AND METHOD OF SUBTERRANEAN DRILLING

(75) Inventor: Michael L. Doster, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/716,626

(22) Filed: Nov. 20, 2000

Related U.S. Application Data

(60) Provisional application No. 60/175,457, filed on Jan. 11, 2000.

(51) Int. Cl.[7] ..... E21B 10/00; E21B 10/16

(52) U.S. Cl. ..... 175/431; 175/498

(58) Field of Search ..... 175/385, 406, 175/408, 412, 431

(56) References Cited

U.S. PATENT DOCUMENTS

| | | | | |
|---|---|---|---|---|
| 5,033,560 A | * | 7/1991 | Sawyer et al. | 175/415 |
| 5,163,524 A | * | 11/1992 | Newton, Jr. et al. | |
| 5,178,222 A | | 1/1993 | Jones et al. | |
| 5,467,836 A | * | 11/1995 | Grimes et al. | |
| 5,549,171 A | | 8/1996 | Mensa-Wilmot et al. | |
| 5,582,261 A | | 12/1996 | Keith et al. | |
| 5,607,025 A | | 3/1997 | Mensa-Wilmot et al. | |
| 5,651,421 A | * | 7/1997 | Newton et al. | |
| 5,873,422 A | | 2/1999 | Hansen et al. | |
| 5,937,958 A | | 8/1999 | Mensa-Wilmot et al. | |
| 5,967,247 A | * | 10/1999 | Pessier | 175/406 |
| 5,979,577 A | | 11/1999 | Fielder | |
| 5,988,303 A | | 11/1999 | Arfele | |
| 6,062,325 A | | 5/2000 | Taylor et al. | |
| 6,123,160 A | * | 9/2000 | Tibbitts et al. | |
| 6,308,790 B1 | * | 10/2001 | Mensa-Wilmot et al. | |

FOREIGN PATENT DOCUMENTS

| | | |
|---|---|---|
| EP | 0 127 077 A2 | 5/1984 |
| EP | 0 710 765 A2 | 5/1996 |
| GB | 2 298 668 A | 9/1996 |
| GB | 2 317 632 A | 4/1998 |
| GB | 2 352 748 A | 2/2001 |

OTHER PUBLICATIONS

Search Report of Aug. 1, 2002.
Search Report dated Jun. 21, 2001.

* cited by examiner

*Primary Examiner*—David Bagnell
*Assistant Examiner*—Daniel P Stephenson
(74) *Attorney, Agent, or Firm*—TraskBritt

(57) ABSTRACT

A fixed cutter, or rotary drag, bit exhibiting enhanced lateral stability for drilling subterranean formations and a method of drilling. The bit includes one or more gage pads longitudinally extended in the direction of the leading end of the bit and preferably forwardly of the bit face, the gage pads and preferably the adjacent shoulder regions each bearing at least one cutting element thereon exhibiting a reduced exposure in comparison to cutting elements carried on the face of the bit. The increased gage pad area may be employed as a bearing area to accommodate a large resultant lateral force vector and the extended, reduced-exposure cutting element-carrying gage pads and adjacent shoulder regions may be deployed about the entire circumference of the bit so the direction of any resultant force vector is substantially immaterial to the bit design.

13 Claims, 7 Drawing Sheets

DRILL BIT WITH LATERAL MOVEMENT MITIGATION AND METHOD OF SUBTERRANEAN DRILLING

CROSS-REFERENCE TO RELATED APPLICATIONS

This application claims the benefit of U.S. provisional patent application, Serial No. 60/175,457, filed Jan. 11, 2000.

BACKGROUND OF THE INVENTION

1. Field of the Invention

The present invention is related to rotary drilling of subterranean formations and, more specifically, to a rotary drill bit exhibiting particularly beneficial lateral stabilization characteristics, as well as a method of drilling subterranean formations with such a rotary drill bit.

2. State of the Art

Equipment used in subterranean drilling operations is well known in the art and generally comprises a rotary drill bit attached to a drill string, including drill pipe and drill collars. A rotary table or other device such as a top drive is used to rotate the drill string from a drilling rig, resulting in a corresponding rotation of the drill bit at the free end of the string. Fluid-driven downhole motors are also commonly employed, generally in combination with a rotatable drill string, but in some instances as the sole source of rotation for the bit. The drill string typically has an internal bore extending from and in fluid communication between the drilling rig at the surface and the exterior of the drill bit. The string has an outer diameter smaller than the diameter of the well bore being drilled, defining an annulus between the drill string and the wall of the well bore for return of drilling fluid and entrained formation cuttings to the surface.

An exemplary rotary drill bit includes a bit body secured to a steel shank having a threaded pin connection for attaching the bit body to the drill string, and a body or crown comprising that part of the bit fitted on its exterior with cutting structures for cutting into an earth formation. Generally, if the bit is a fixed-cutter or so-called "drag" bit, the cutting structure includes a plurality of cutting elements including cutting surfaces formed of a superabrasive material such as polycrystalline diamond and oriented on the bit face generally in the direction of bit rotation. A drag bit body is generally formed of machined steel or a matrix casting of hard particulate material such as tungsten carbide in a (usually) copper-based alloy binder.

In the case of steel body bits, the bit body is usually machined, typically using a computer-controlled, five-axis machine tool, from round stock to the desired shape, including internal watercourses and passages for delivery of drilling fluid to the bit face, as well as cutting element pockets or sockets and ridges, lands, nozzle displacements, junk slots and other external topographic features. Hardfacing is applied to the bit face and to other critical areas of the bit exterior, and cutting elements are secured to the bit face, generally by inserting the proximal ends of studs on which the cutting elements are mounted into apertures (sockets) bored into the bit face or, if cylindrical cutting elements are employed, by inserting the substrates into pockets bored into the bit face. The end of the bit body opposite the bit face is then threaded, made up and welded to the bit shank.

The body of a matrix-type drag bit is cast in a mold interiorly configured to define many of the topographic features on the bit exterior, with additional preforms placed in the mold defining the remainder of such features as well as internal features such as watercourses and passages. Tungsten carbide powder and sometimes other metals to enhance toughness and impact resistance are placed in the mold under a liquefiable binder in pellet form. The mold assembly, including a steel bit blank having one end inserted into the tungsten carbide powder, is placed in a furnace to liquify the binder and form the body matrix with the steel bit blank integrally secured to the body. The blank is subsequently affixed to the bit shank by welding. Superabrasive cutting elements, also termed "cutters" herein, may be secured to the bit face during the furnacing operation if the elements are of the so-called "thermally stable" type, or may be brazed by their supporting (usually cemented WC) substrates to the bit face, or to WC preforms furnaced into the bit face during infiltration. Such superabrasive cutting elements include polycrystalline diamond compacts (PDCs), thermally stable polycrystalline diamond compacts (generally termed "TSPs" for thermally stable products), natural diamonds and, to a lesser extent, cubic boron nitride compacts.

Rotary drill bits, and more specifically drag bits, may be designed as so-called "anti-whirl" bits. Such bits use an intentionally unbalanced and oriented lateral or radial force vector, usually generated by the bit's cutters, to cause one side of the bit configured as an enlarged, cutter-devoid bearing area comprising one or more gage pads to ride continuously against the side wall of the well bore to prevent the inception of bit "whirl", a well-recognized phenomenon wherein the bit precesses around the well bore and against the side wall in a direction counter to the direction in which the bit is being rotated. Whirl can result at the least in an over-gage and out-of-round well bore and, at its worst, in damage to the cutters and bit itself. Anti-whirl bits have been designed, built and run commercially, with some success. However, the necessity to calculate, and usually redirect, the lateral imbalance forces generated by engagement of a formation by a bit under rotation and weight on bit (WOB) so that the resultant lateral force vector intersects the bearing area results in additional expense in the first instance of completing a given bit design. Further, if the size, shape, type, orientation or location of any cutting element is desired or required to be changed, the magnitude and direction of the resultant lateral force vector must be recalculated, and possibly further design modifications effected to the bit to ensure proper direction and magnitude of the resultant lateral force vector.

Another disadvantage of anti-whirl bits is related to the absence of cutting elements on the shoulder as well as the gage in the bearing area, often in conjunction with longitudinally extending the gage pad or pads. While bits of such designs exhibit a high side force directed to the relatively low-friction gage pad or pads in the bearing area, resulting in reduced vibration and a smooth-running bit, the absence of the gage and shoulder cutting elements in the bearing area significantly reduces the life of the bit through premature wear.

Thus, it would be beneficial to the drill bit design to achieve a smooth-running, low-vibration drill bit which does not require the intricacies of anti-whirl bit design and re-design and which, at the same time, provides a useful life on the order of that obtainable by a conventional, nonanti-whirl drill bit.

BRIEF SUMMARY OF THE INVENTION

The present invention provides a fixed cutter, or rotary drag, bit exhibiting enhanced lateral stability and reduced vibrational tendencies comparable to an anti-whirl bit, while at the same time providing a greater useful life in terms of resistance to wear.

The rotary drag bit of the present invention includes a bit body having a face over which may extend a plurality of generally radially extending blades, each bearing a plurality of superabrasive cutting elements. The bit body also includes a plurality of gage pads, which may comprise longitudinal extensions of the blades, or be discontinuous therewith. At least one gage pad of the plurality exhibits a longitudinal elongation toward, or even longitudinally below, the face of the bit which moves the shoulder region comprising a transition between the gage and the face profiles downwardly, as the bit is normally oriented for drilling. At least one cutting element is placed in the area of gage pad elongation, the at least one cutting element exhibiting an exposure less than the exposure of cutting elements on the bit face. Desirably, at least another reduced-exposure cutting element is placed in the shoulder region forming the transition between the gage pad and its associated blade.

The rotary drag bit of the present invention may be configured as a conventional or anti-whirl bit in terms of the degree and magnitude of the resultant lateral force vector causing lateral imbalance of the bit. However, a bit in accordance with the present invention may also employ all of the gage pads in the above-described longitudinally elongated configuration, each of the gage pads bearing at least one cutting element of lesser exposure than the bit face cutting elements and at least another cutting element of lesser exposure on the shoulder region. By using such an approach, the direction of lateral bit imbalance is of little or no concern to the bit designer, who need only determine that the magnitude of such imbalance is within certain broad parameters. Further, the magnitude of the lateral bit imbalance may be increased beyond that deemed wise conventionally, so as to more firmly stabilize the rotating bit against the side wall of the borehole, the extended gage region and reduced-exposure cutting elements providing sufficient durability and wear resistance to accommodate the increased lateral loading.

Thus, a bit in accordance with the present invention may be of conventional design and exhibit a wide variation in lateral imbalance, from a very low magnitude to a magnitude in excess of what have hitherto been deemed to be acceptable levels, or may be of an anti-whirl design. In addition, the term "rotary drill bit" or "bit" as employed herein encompasses core bits, bi-center bits, eccentric bits, reaming-while-drilling (RWD) tools, as well as other rotary drilling structures which may benefit from the improvements and advantages afforded by the present invention.

The present invention also encompasses a method of drilling subterranean formations.

BRIEF DESCRIPTION OF THE SEVERAL VIEWS OF THE DRAWINGS

FIGS. 4A and 4B comprise side profiles of bits bearing the same cutting structure, wherein FIG. 4A depicts a bit exhibiting a conventional profile and FIG. 4B depicts a bit exhibiting a profile according to the present invention.

DETAILED DESCRIPTION OF THE INVENTION

Figure 1:
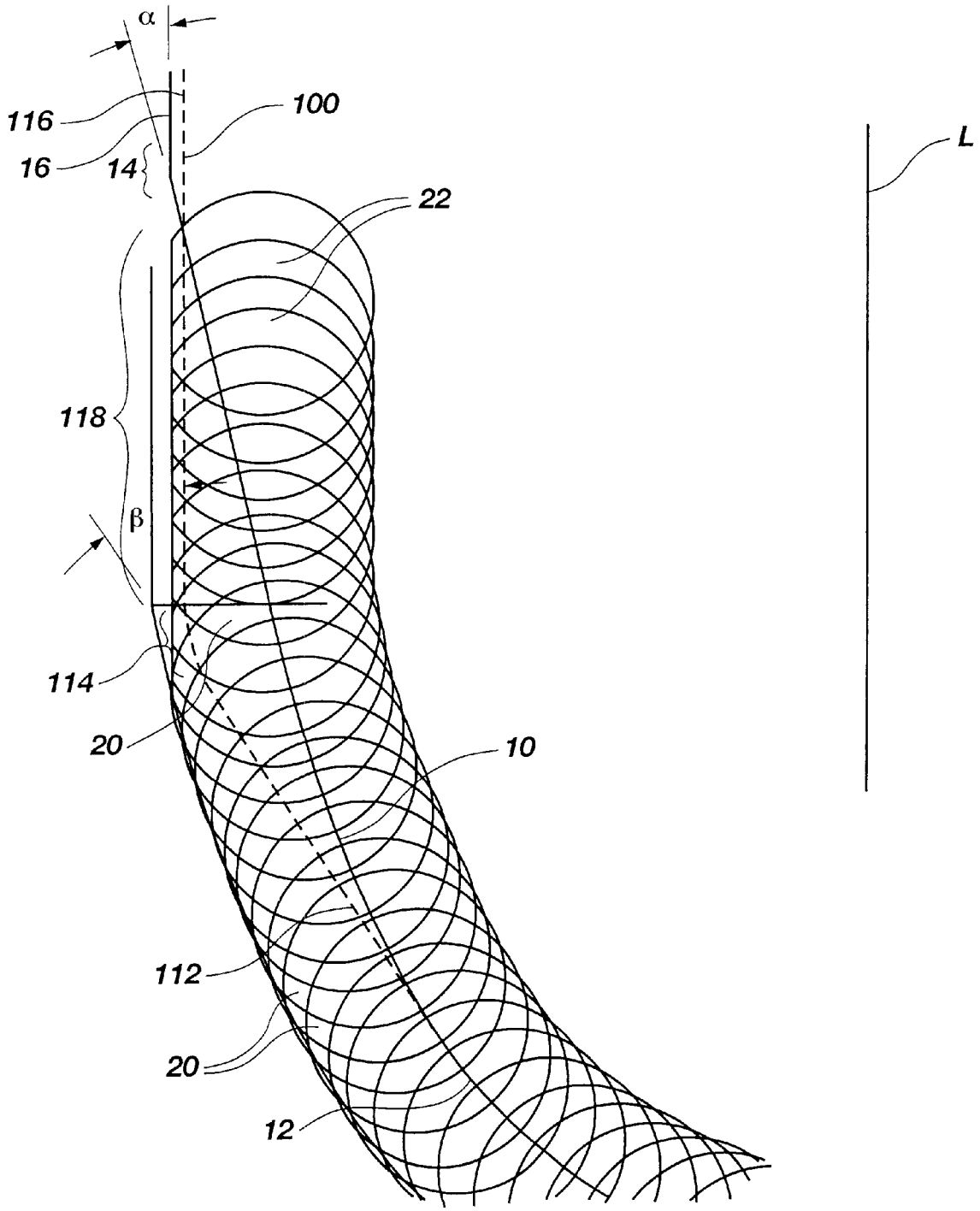
FIG. 1 of the drawings comprises a view of superimposed partial bit blade profiles in the shoulder region, one of conventional configuration and the other configured according to the invention, the latter showing cutter placements.

Referring to FIG. 1 of the drawings, two superimposed partial bit blade profiles 10 (solid line) and 100 (broken line) are shown. Profile 10 exemplifies a blade 12 extending radially outwardly and longitudinally upwardly at a relaxed, relatively small angle $\alpha$ to the bit axis L to and through a shoulder region 14 to a gage pad 16, such a configuration being currently employed in anti-whirl bit designs. In such designs, shoulder region 14 and gage pad 16 in the bearing area are each completely devoid of cutting elements. Profile 100 exemplifies a blade 112 extending radially outwardly and longitudinally upwardly at a relatively larger angle $\beta$ to the bit axis L to and through a shoulder region 114 to a gage pad 116 including extended gage region 118 longitudinally elongated in a direction toward, or even in advance of, the bit face according to the invention. As shown on the profiles 10 and 100, a plurality of cutting elements 20 and a plurality of flat-edged gage cutting elements 22 which are, in fact, distributed over the bit face and at different circumferential locations around the gage have been rotationally superimposed into a single plane for clarity It can be readily appreciated that at least one, and preferably several, of the gage cutting elements 22 which would be missing from profile 10 (and thus carried on other gage pads circumferentially outside the bearing area of the anti-whirl bit) are carried on extended gage region 118. As shown, cutting elements 20 on shoulder region 114 and gage cutting elements 22 on extended gage region 118 of profile 100 are of lesser exposure, or height, above (e.g., outwardly from) the profile in comparison to cutting elements 20 carried on blade 112 over the bit face. Thus, while not cutting aggressively, as do cutting elements 20 on the blade 112 over the bit face, the shoulder region cutting elements 20 and extended gage region cutting elements 22 provide enhanced durability and wear resistance to the bit body in those areas. It should also be noted that gage cutting elements 22 and shoulder region cutting elements 20 exhibit, on those blades 12 carrying same on conventional profile 10, much greater exposure than on extended gage region 118 and shoulder region 114 on profile 100. Thus, these cutting elements take a greater depth of cut and perform much more aggressively on profile 10 than on profile 100, consequently being more likely to excite vibration.

While it has been asserted by those skilled in the art that a cutter-devoid, low-friction gage pad in the context of an anti-whirl bit is the only means by which bit vibration, and specifically whirl, may be attenuated, the inventor herein has determined that such is not the case. Rather, by longitudinally extending all of the gage pads toward the bit face and placing reduced-exposure cutting elements on the extended gage regions, an anti-whirl bit design is rendered unnecessary, as any lateral imbalance force exhibited by the bit under rotation and WOB is sufficiently accommodated by the present invention anywhere about the circumference of the bit. Furthermore, if it is desired to employ a lateral force vector, such vector does not have to be aimed at any particular circumferential location or region, but again is sufficiently accommodated by the present invention regardless of direction. In addition, the present invention provides the opportunity to even increase the lateral force pushing a bit against the borehole wall to stabilize the bit, while the reduced-exposure cutting elements in the shoulder region and extended gage region provide durability without inciting whirl or other vibratory tendencies.

Figure 2B:
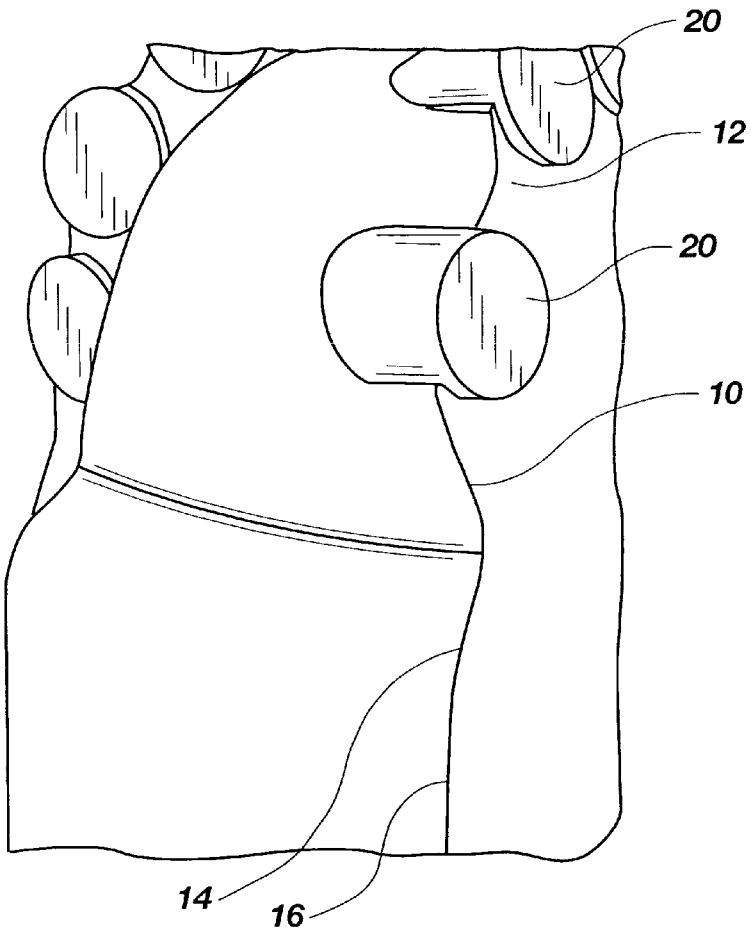
Fig. 2B (PRIOR ART)
FIGS. 2A and 2B comprise enlarged perspective views of a conventional gage pad and shoulder design for a low-friction gage pad as employed in the bearing area of an anti-whirl drill bit.
Figure 2A:
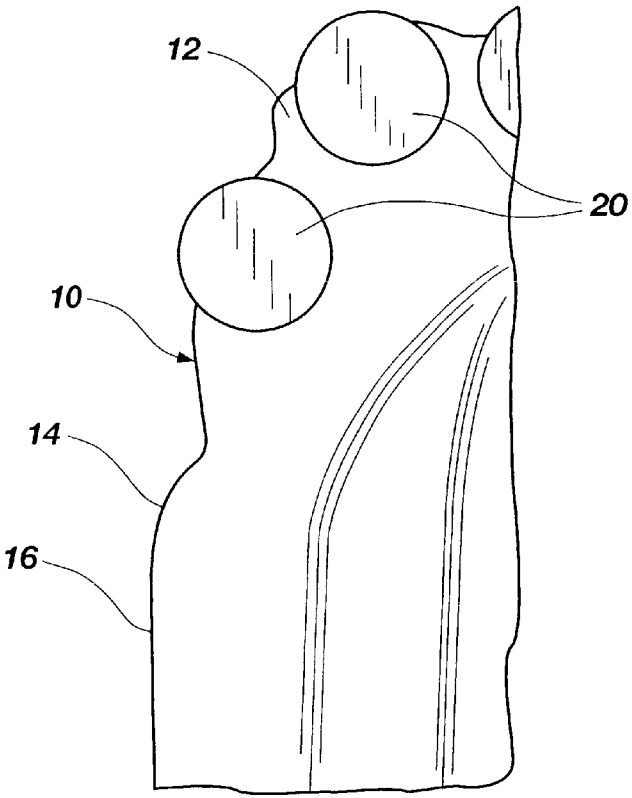
Fig. 2A (PRIOR ART)

FIGS. 2A and 2B of the drawings depict, in an enlarged, inverted, perspective view, a blade 12 of a bit having a conventional anti-whirl profile 10, cutting elements 20 being carried on blade 12 while shoulder region 14 and gage pad 16 therebelow are completely devoid of cutting elements. As may readily be appreciated from FIGS. 2A and 2B, the shoulder region 14 and gage pad 16 are substantially unprotected from wear and damage resulting from the bit being pushed against the side wall of the borehole under a resultant lateral force vector used to stabilize the bit.

Figure 3C:
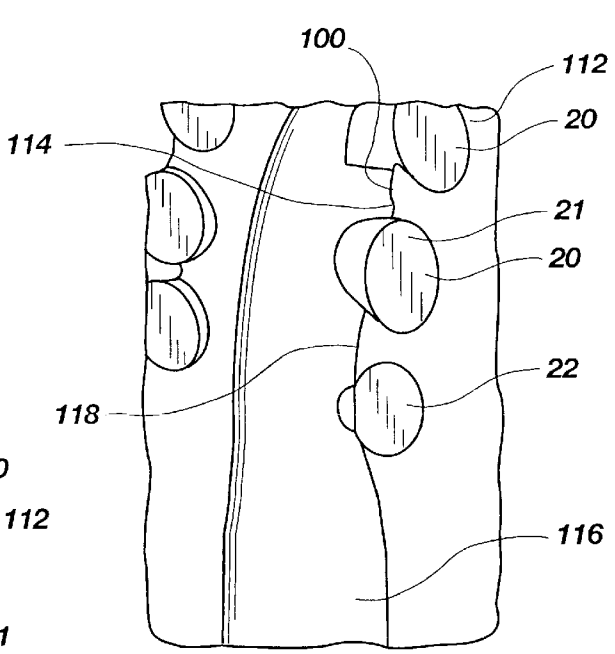
FIGS. 3A, 3B and 3C comprise enlarged perspective views of elongated gage pads and longitudinally displaced shoulder regions according to the present invention.
Figure 3B:
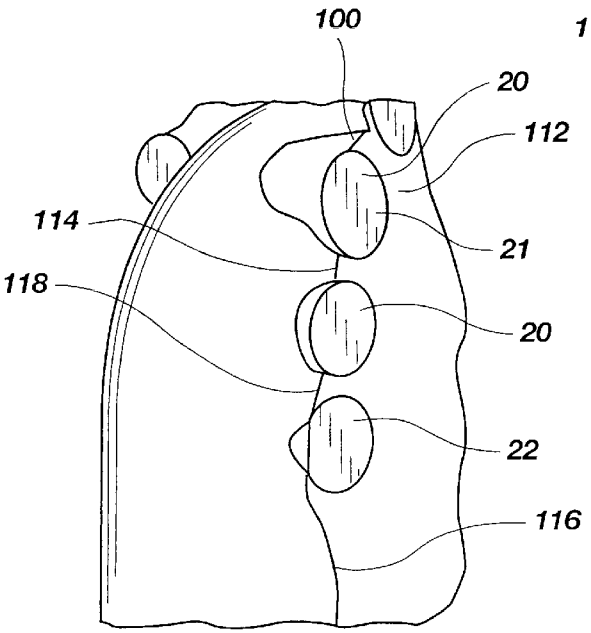
Figure 3A:
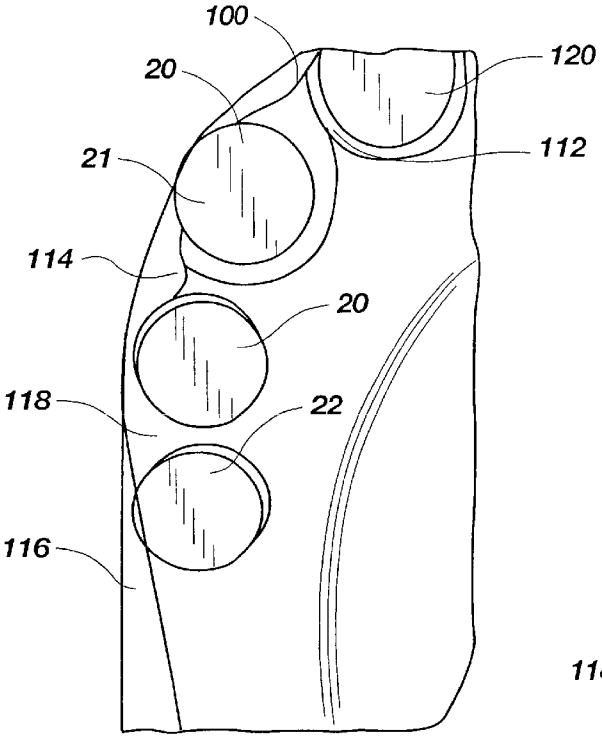

FIGS. 3A, 3B and 3C comprise enlarged, inverted perspective views of blades 112 (FIGS. 3A and 3B depicting one blade 112 and FIG. 3C depicting another blade 112) with associated shoulder regions 114 and extended gage regions 118 of gage pads 116. Reduced exposure gage cutting elements 22 are shown on extended gage regions 118, and reduced exposure cutting elements 20 on shoulder regions 114. By way of comparison with cutting elements 20 carried on blades 112, if such cutting elements 20 are exposed (as is conventional) to a height above the profile of about one-half of the diameter of the cutting faces 21 thereof, the exposure of cutting elements 20 on shoulder regions 114 may be desirably less than the exposure of cutting elements 20 on blades 112, or perceptibly less than one-half of the cutting faces 21. The exposure of gage cutting elements 22 is preferably less than the exposure of cutting elements 20 on shoulder regions 114, and the outer extents of cutting elements 22 may be flush with matrix material of the bit body, the gage cutting elements 22 being exposed as the bit is run due to matrix wear. However, it is currently preferred that gage cutting elements 22 be exposed about 0.025 inch (about 0.6 mm). Thus it will be understood, and is especially well illustrated with reference to FIG. 1, that the exposure of gage cutting elements 22 may be very slight, as no significant cutting action is required and, indeed, the opposite is true. In other words, such cutting elements 22 in combination with cutting elements 20 in shoulder regions 114 are intended only to substantially preserve the integrity of the shoulder regions 114 and gage pads 116, the extended gage region 118 of the latter preventing gage cutting elements 22 from biting into the wall laterally, but not affecting the axial aggressiveness of the bit as the cutting elements 20 cut the borehole.

Figure 4B:
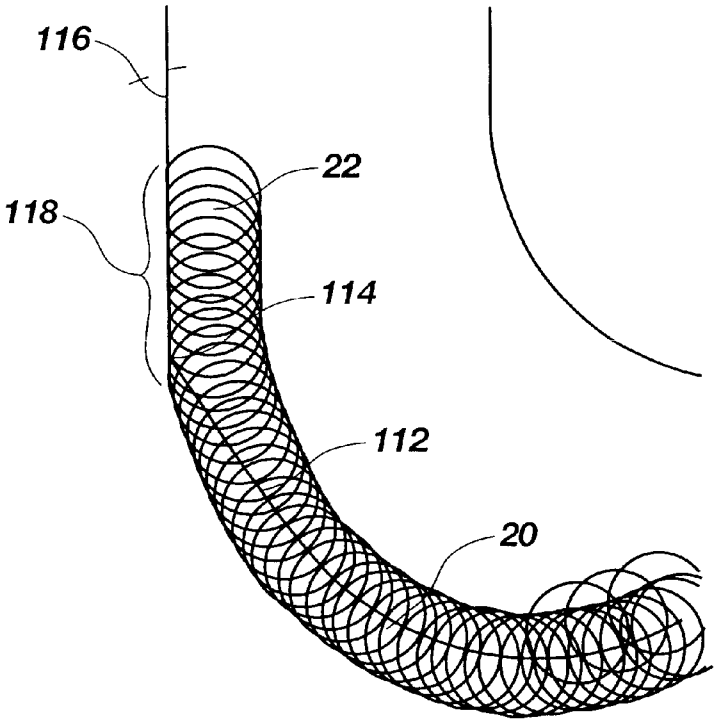
Figure 4A:
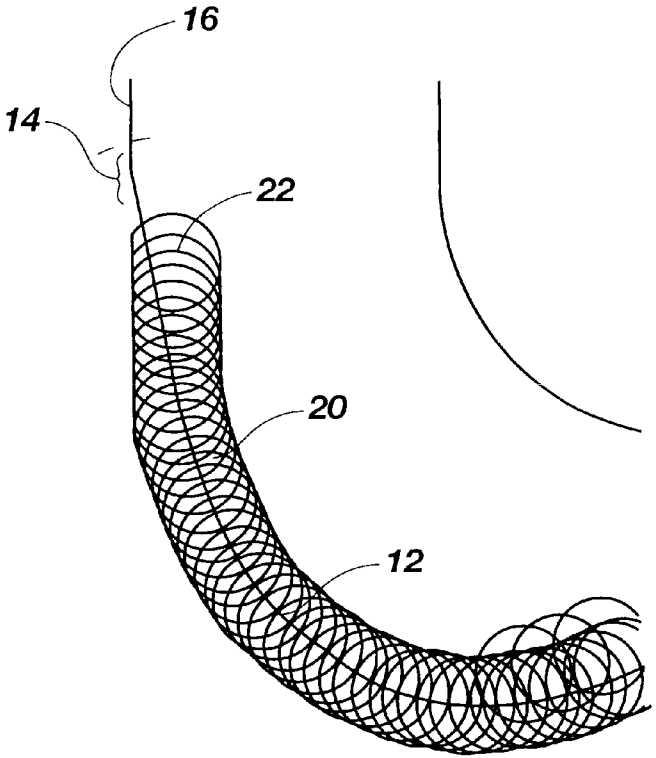
Fig. 4A (PRIOR ART)

FIGS. 4A and 4B further illustrate the physical differences between a bit having a conventional profile (FIG. 4A ) and a profile according to the present invention (FIG. 4B). Reference numerals previously employed herein are used in FIGS. 4A and 4B to identify the same features.

Figure 5A:
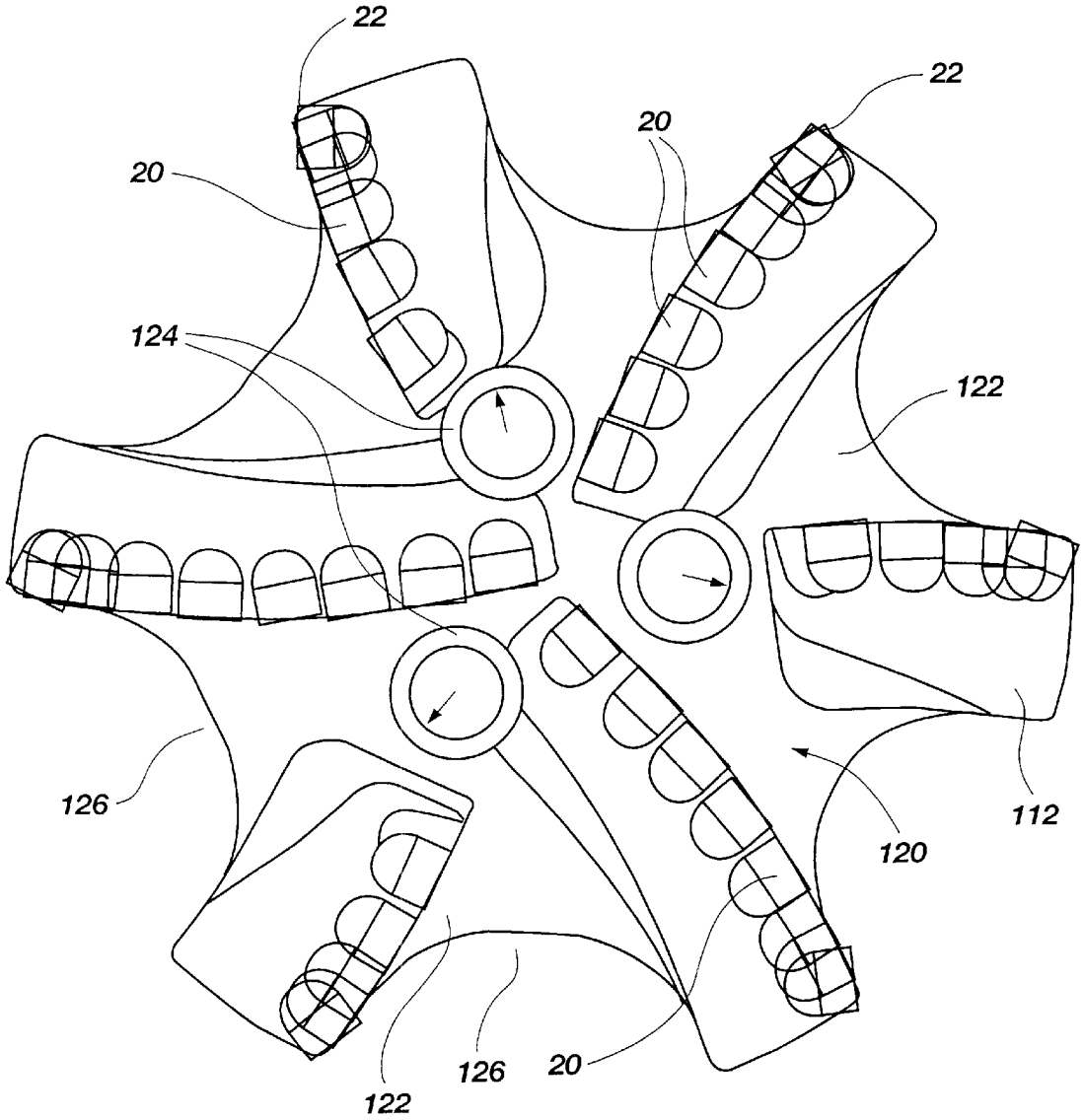
FIGS. 5A, 5B and 5C respectively comprise a face view, a side profile and a side sectional elevation of an exemplary drill bit according to the present invention.
Figure 5B:
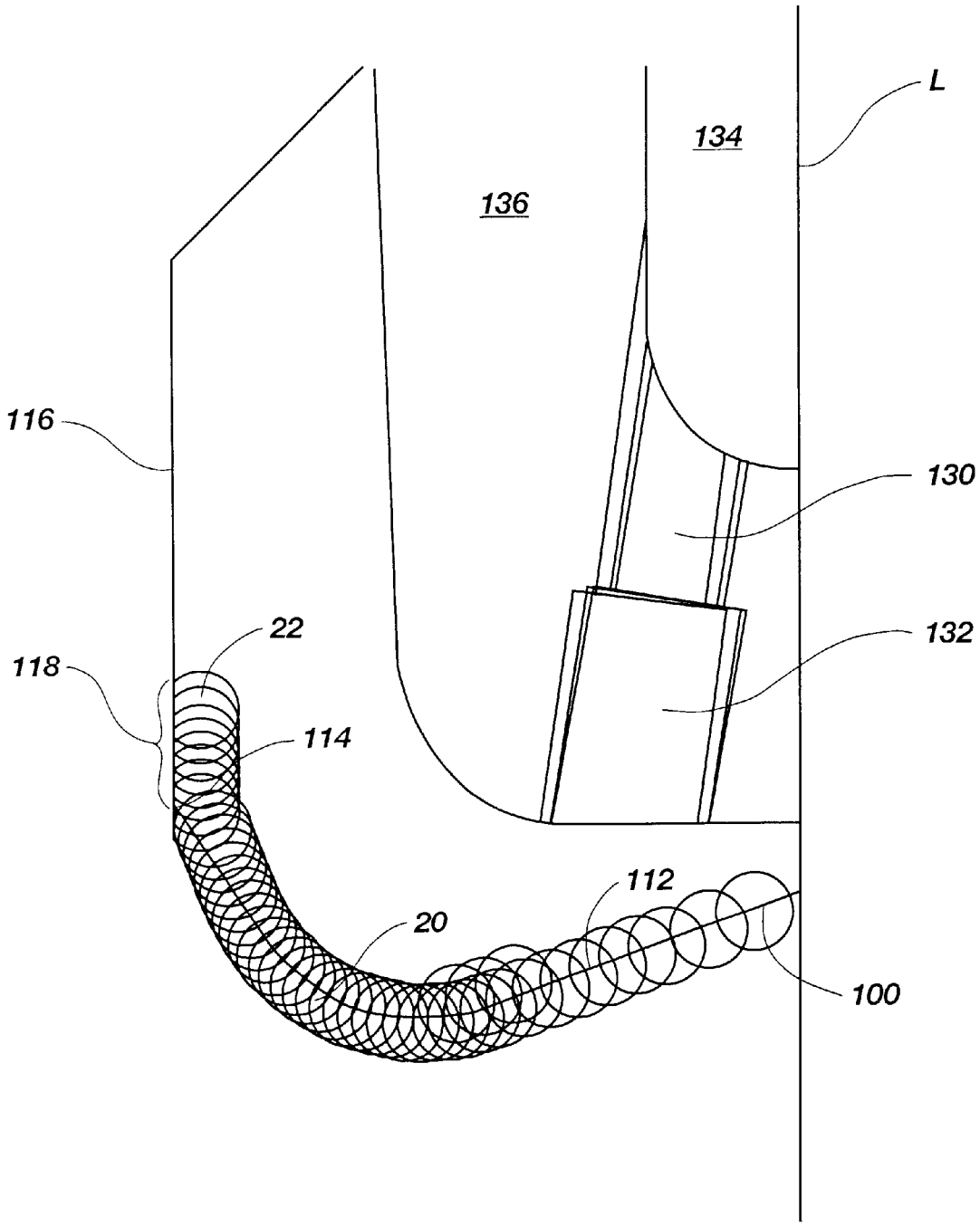
Figure 5C:
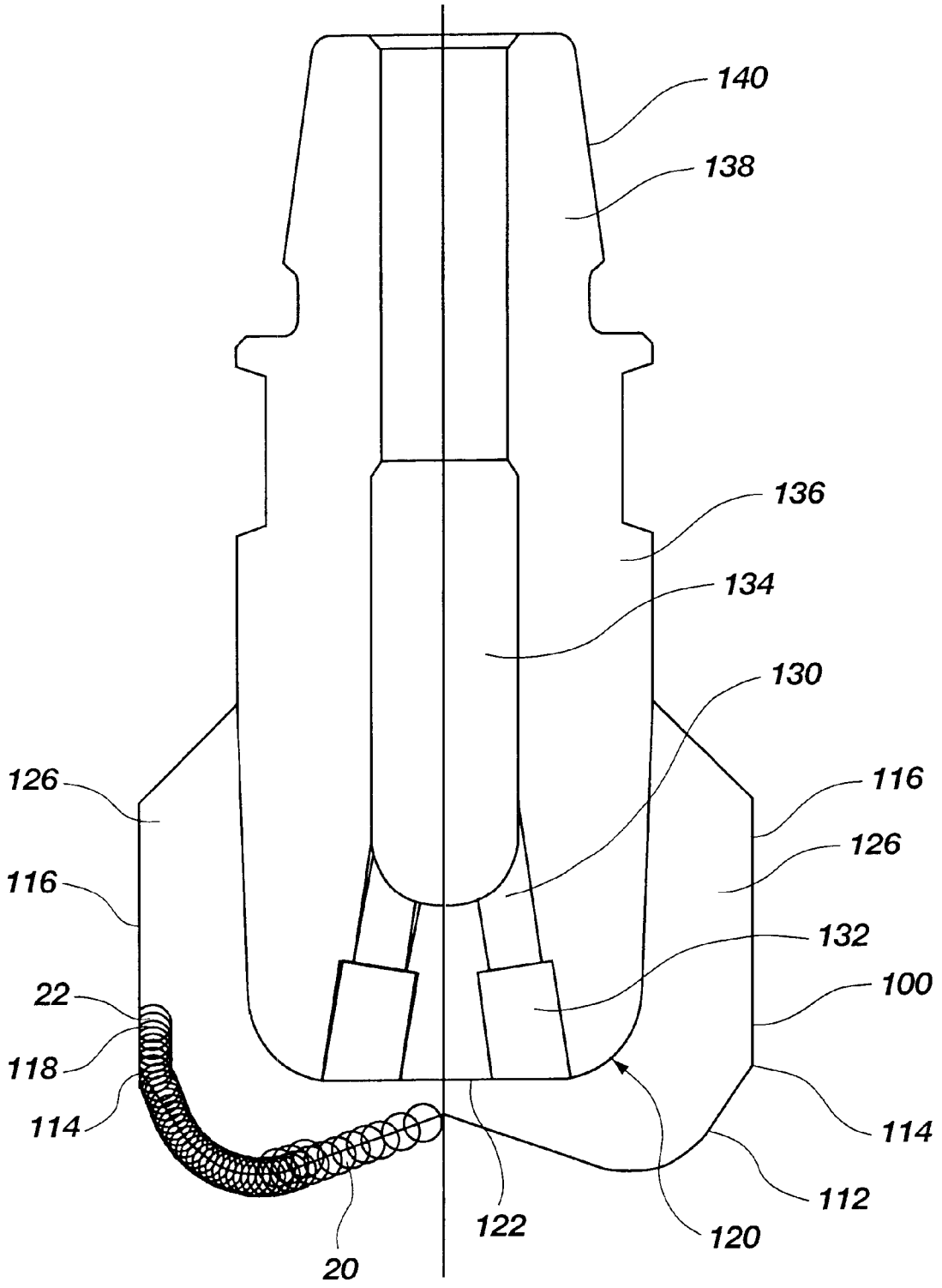

FIGS. 5A, 5B and 5C depict an exemplary 8½ inch, six-bladed rotary drag bit in accordance with the present invention. Reference numerals previously employed herein are used in FIGS. 5A, 5B and 5C to identify the same features. In addition, FIG. 5A depicts the fluid courses 122 on bit face 120, and nozzles 124 proximate the radially inner extents of fluid courses 122, each nozzle substantially providing drilling fluid to two fluid courses 122. It will be noted that the bit includes three relatively longer primary blades 112 which each carry a noticeably larger number of cutting elements 20 than the three relatively shorter secondary blades interspersed therebetween. FIG. 5B depicts the blade profile of the bit according to the present invention, and its relationship to bit face 120 whereon fluid courses 122 are located, leading to junk slots 126 defined between gage pads 116. Radial locations and orientations of passages 130 leading to nozzle locations 132 (nozzles 124 not shown) adjacent fluid courses 122 from plenum 134 inside bit body 136 are also shown. FIG. 5C is a side sectional elevation of the exemplary bit, further including shank 138 which is threaded at 140 to effect a connection to a drill string or a drive shaft of a downhole motor, as known in the art.

It should be noted that superabrasive cutting elements, and specifically PDCs, are the currently preferred structures for cutting elements 20 and 22. The manner in which the exposure of gage cutting elements 22 and cutting elements 20 in the shoulder region of bits according to the invention may be reduced may vary. For example, smaller diameter cutting elements may be employed than those employed on the blades over the bit face, the cutting elements may be physically more closely inset toward the profile, the rake angle may be increased more negatively, the cutting edges may be trimmed as by electrodischarge machining (EDM) to reduce exposure, or a combination of such approaches may be employed. However, the invention is not limited to implementation with PDC cutting elements, and other superabrasive cutting structures, including without limitation TSPs, natural diamonds, diamond films and cubic boron nitride, may be employed.

The present invention, by employing enhanced gage pad bearing surfaces in combination with reduced-exposure cutting elements on the extended gage regions, as well as on the adjacent shoulder regions, greatly enhances lateral stability and attenuates vibrational tendencies associated with lateral bit movement without sacrificing longevity and durability as in prior art anti-whirl bits with their cutter-devoid, low-friction gage pads and adjacent shoulder regions in the bearing area. Moreover, bits configured according to the present invention may be designed in a more straightforward manner than such prior art anti-whirl bits with their requirements for alteration of cutting element numbers, positions and orientations to achieve a directed resultant lateral force vector within a certain magnitude range. Further, since bits according to the present invention will operate effectively regardless of the direction and magnitude of any resultant lateral force vector, cutting elements may be placed on such bits to optimize cutting action and to increase hydraulic efficiency, facilitating increases in rate of penetration (ROP) absent many constraints imposed by prior art anti-whirl bit designs. Thus, the present invention includes a method of drilling demonstrating enhanced lateral stability while, at the same time, facilitating increased flexibility in bit design to achieve superior performance.

While the present invention has been described in the context of certain preferred embodiments, those of ordinary skill in the art will understand and appreciate that the invention is not so limited. Specifically, additions and modifications to, and deletions from, the embodiments described and illustrated herein may be made without departing from the scope of the invention as hereinafter claimed.

What is claimed is:

1. A rotary drag bit for drilling a subterranean formation, comprising:

a bit body having a longitudinal axis and including a face at a leading end thereof and structure for connecting the rotary drag bit to a drill string at a trailing end thereof;

a plurality of generally radially extending blades over the bit face, each blade carrying at least one superabrasive cutting structure thereon;

a plurality of gage pads circumferentially spaced about the bit body, defining junk slots therebetween and including radially outer bearing surfaces substantially parallel to the longitudinal axis, at least one of the plurality of gage pads including a longitudinally extended gage region toward the leading end and proximate the bit face and carrying at least one superabrasive cutting structure thereon having an exposure less than an exposure of at least a majority of the superabrasive cutting structures carried by the blades; and a shoulder region proximate a leading end of each of the plurality of gage pads and carrying at least one superabrasive cutting structure thereon having an exposure less than the exposure of at least the majority of the superabrasive cutting structures outside the shoulder region carried by the blades.

2. The rotary drag bit of claim 1, wherein the extended gage region extends longitudinally leading in advance of the longitudinally most trailing extent of the bit face as the rotary drag bit is oriented for drilling.

3. The rotary drag bit of claim 1, wherein the at least one of the gage pads comprises a plurality of gage pads.

4. The rotary drag bit of claim 1, wherein the at least one of the gage pads comprises all of the gage pads.

5. The rotary drag bit of claim 1, wherein the superabrasive cutting structures comprise PDC cutting elements.

6. The rotary drag bit of claim 1, wherein the at least one superabrasive cutting structure on the at least one gage pad comprises at least one PDC cutting element.

7. The rotary drag bit of claim 1, wherein at least one of the plurality of gage pads is substantially contiguous with one of the plurality of blades.

8. The rotary drag bit of claim 1, wherein each of the gage pads is substantially contiguous with a blade.

9. The rotary drag bit of claim 1, wherein at least one superabrasive cutting structure carried by the longitudinally extending gage region has an exposure less than any superabrasive cutting structure carried by the shoulder region.

10. A rotary drag bit for drilling a subterranean formation, comprising:

a bit body having a longitudinal axis and including a face at a leading end thereof and structure for connecting the rotary drag bit to a drill string at a trailing end thereof;

a plurality of generally radially extending blades over the bit face, each blade carrying a plurality of PDC cutting elements thereon;

a plurality of gage pads circumferentially spaced about the bit body, defining junk slots therebetween and including radially outer bearing surfaces substantially parallel to the longitudinal axis, each gage pad being substantially contiguous with a blade, at least some of the gage pads each including a longitudinally extended region leading at least a portion of the bit face and carrying at least one PDC cutting element thereon exhibiting an exposure less than an exposure exhibited by the PDC cutting elements carried by the blades; and a shoulder region defining a transition between each blade substantially contiguous with a gage pad including a longitudinally extended region, each shoulder region carrying at least one PDC cutting element thereon exhibiting an exposure less than an exposure exhibited by at least the majority of the PDC cutting elements outside the shoulder region carried by the blades.

11. The rotary drag bit of claim 10, wherein at least one PDC cutting element within the longitudinally extending region has an exposure less than any PDC cutting element carried by the shoulder region.

12. A rotary drilling structure for drilling a subterranean formation, comprising:

a body having a leading end, a trailing end, a longitudinal axis and structure for connecting the drilling structure to a drill string at a trailing end thereof, a plurality of generally radially extending blades, each blade carrying at least one superabrasive cutting structure thereon;

a plurality of gage pads circumferentially spaced about the body, defining junk slots therebetween and including radially outer bearing surfaces substantially parallel to the longitudinal axis, at least one of the gage pads including a region longitudinally extended toward the leading end and carrying at least one superabrasive cutting structure thereon having an exposure less than an exposure of at least a majority of the superabrasive cutting structures carried by the blades; and a shoulder region proximate a leading end of each of the plurality of gage pads and carrying at least one superabrasive cutting structure thereon having an exposure less than the exposure of at least the majority of the superabrasive cutting structures outside the shoulder region carried by the blades.

13. The rotary drilling structure of claim 12, wherein at least one superabrasive cutting structure within the gage pad region longitudinally extended toward the leading end has an exposure less than any superabrasive cutting structure carried by the shoulder region.

* * * * *

UNITED STATES PATENT AND TRADEMARK OFFICE

CERTIFICATE OF CORRECTION

PATENT NO. : 6,575,256 B1
DATED : June 10, 2003
INVENTOR(S) : Michael L. Doster

It is certified that error appears in the above-identified patent and that said Letters Patent is hereby corrected as shown below:

Title page, Item [54] Column 1, lines 1-3,
Title, should read as follows:
-- DRILL BIT WITH LATERAL MOVEMENT MITIGATION --

Column 4,
Line 30, insert a period after "clarity"

Column 6,
Line 16, after "employed" and before "than" insert -- other --

Column 7,
Line 36, change "extending" to -- extended --

Column 8,
Line 17, change "extending" to -- extended --

Signed and Sealed this

Fifteenth Day of February, 2005

JON W. DUDAS
*Director of the United States Patent and Trademark Office*